US007825744B2

(12) United States Patent
Kawanami

(10) Patent No.: US 7,825,744 B2
(45) Date of Patent: Nov. 2, 2010

(54) NONRECIPROCAL CIRCUIT DEVICE

(75) Inventor: Takashi Kawanami, Oumihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/782,728

(22) Filed: May 19, 2010

(65) Prior Publication Data

US 2010/0219903 A1 Sep. 2, 2010

Related U.S. Application Data

(63) Continuation of application No. PCT/JP2009/054253, filed on Mar. 6, 2009.

(30) Foreign Application Priority Data

Jun. 18, 2008 (JP) ..... 2008-159414

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,262,639 B1 7/2001 Shu et al.
7,737,801 B2 * 6/2010 Kishimoto ..... 333/24.2
2007/0030089 A1 2/2007 Hino

FOREIGN PATENT DOCUMENTS

| | | | |
|---|---|---|---|
| JP | 2000-031706 | A | 1/2000 |
| JP | 2006-033482 | A | 2/2006 |
| JP | 2006-211373 | A | 8/2006 |
| WO | 2006/080172 | A1 | 8/2006 |

OTHER PUBLICATIONS

Official Communication issued in International Patent Application No. PCT/JP2009/054253, mailed on Jun.16, 2009.

* cited by examiner

*Primary Examiner*—Stephen E Jones
(74) *Attorney, Agent, or Firm*—Keating & Bennett, LLP

(57) ABSTRACT

A nonreciprocal circuit device attenuates unnecessary waves having a higher frequency than that of a fundamental wave, without increasing insertion loss. The nonreciprocal circuit device in the form of a 2-port type isolator includes a ferrite on which a first central electrode and a second central electrode are arranged to cross each other and so as to be electrically insulated from each other. A bypass circuit including a phase shifter and a filter is provided between an input port and an output port, and the bypass circuit does not allow signals in the fundamental wave band to pass through and also attenuates harmonics.

6 Claims, 8 Drawing Sheets

NONRECIPROCAL CIRCUIT DEVICE

BACKGROUND OF THE INVENTION

1. Field of the Invention

The present invention relates to a nonreciprocal circuit device and, in particular, to a nonreciprocal circuit device, such as an isolator or a circulator, used in microwave bands.

2. Description of the Related Art

A nonreciprocal circuit device, such as an isolator or a circulator, has known characteristics that allow for transmission of a signal in a predetermined direction and not in a reverse direction. Because of these characteristics, for example, the isolator is used in a transmitter circuit of a mobile communication device, such as an automobile telephone or a cellular phone, for example.

Generally, this type of nonreciprocal circuit device includes a magnet assembly composed of ferrite provided with a center electrode and a permanent magnet for applying a direct current magnetic field thereto and a predetermined matching circuit element composed of a resistor and a capacitor.

International Publication No. 2006/080172 describes a 2-port isolator in which a coupling capacitor is connected between an input port and an output port for making insertion loss low. Japanese Unexamined Patent Application Publication No. 2006-211373 describes a 2-port isolator in which a coupling inductor is connected between an input port and an output port for the same purpose. Although it is possible to obtain preferable insertion loss with these isolators, attenuation of unnecessary waves, such as second and third harmonic waves, is not considered or addressed in the prior art isolators.

SUMMARY OF THE INVENTION

In view of the above, preferred embodiments of the present invention provide a nonreciprocal circuit device that can attenuate unnecessary harmonic waves having a frequency higher than a fundamental wave without increasing insertion loss.

A nonreciprocal circuit device according to a preferred embodiment of the present invention includes a permanent magnet, a ferrite arranged to receive a direct-current magnetic field from the permanent magnet, a first central electrode and a second central electrode arranged on the ferrite so as to cross each other and so as to be electrically insulated from each other, a first end of the first central electrode is electrically connected to an input port and a second end of the first central electrode is electrically connected to an output port, a first end of the second central electrode is electrically connected to the output port and a second end of the second central electrode is electrically connected to a ground port, a first matching capacitor electrically connected between the input port and the output port, a second matching capacitor electrically connected between the output port and the ground port, a resistor electrically connected between the input port and the output port, and a bypass circuit electrically connected between the input port and the output port and including a phase shift portion and a filter portion arranged to prevent signals in a fundamental wave band from passing through the bypass circuit, wherein the bypass circuit is arranged such that, while performing phase shifting, the bypass circuit generates unnecessary waves having an opposite phase to that of unnecessary waves at the output port, and the bypass circuit selectively passes the generated unnecessary waves having the opposite phase to cancel out the unnecessary waves at the output port.

With the nonreciprocal circuit device described above, unnecessary waves pass through the bypass circuit provided between the input port and the output port. Since the unnecessary waves passing through the bypass circuit have a phase that is opposite to that of unnecessary waves passing through a main circuit of the nonreciprocal circuit device, unnecessary waves are greatly attenuated at the output port. In addition, since an input-output impedance of the filter is extremely high in the operating fundamental wave band, the bypass circuit does not influence the operation of the nonreciprocal circuit device at the fundamental frequency band.

According to a preferred embodiment of the present invention, a bypass circuit is arranged to perform phase shifting and filtering between the input port and the output port, and the bypass circuit does not allow operating wave signals to pass therethrough, unnecessary waves having a frequency higher than a fundamental wave can be attenuated without increasing insertion loss.

Other features, elements, steps, characteristics and advantages of the present invention will become more apparent from the following detailed description of preferred embodiments of the present invention with reference to the attached drawings.

BRIEF DESCRIPTION OF THE PREFERRED EMBODIMENTS

DETAILED DESCRIPTION OF THE PREFERRED EMBODIMENTS

Nonreciprocal circuit devices of the preferred embodiments of the present invention are described below with reference to the accompanying drawings. The same reference numbers are given to common elements of each preferred embodiment and duplicated descriptions are omitted.

Figure 1:
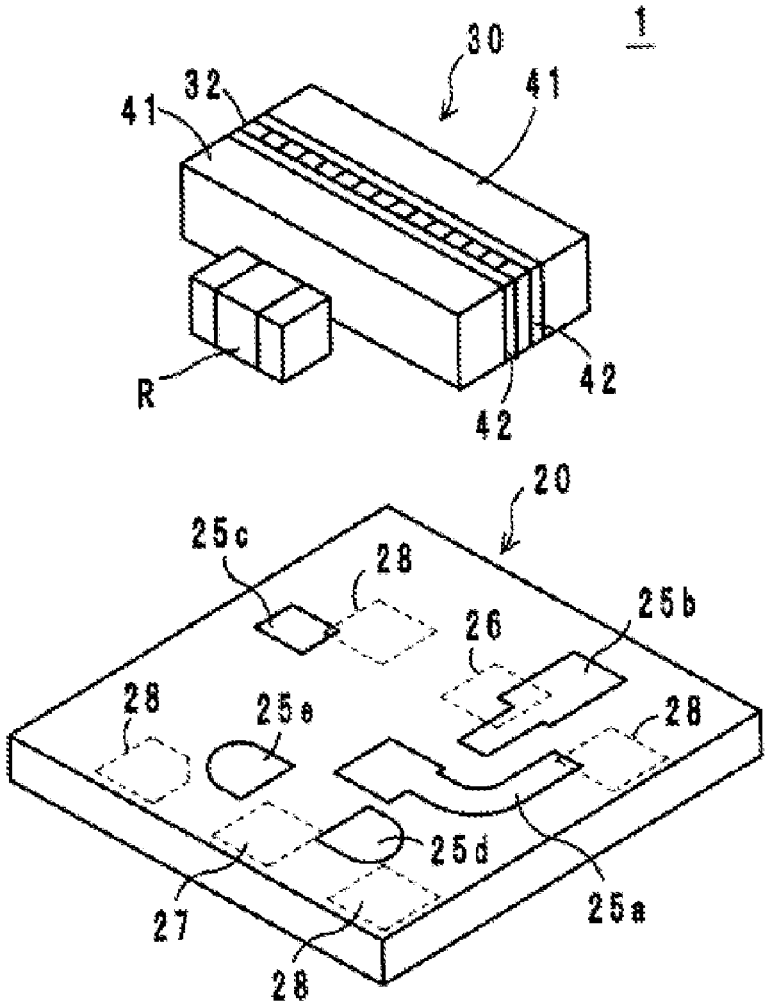
FIG. 1 is a perspective view illustrating a basic structure of a nonreciprocal circuit device (2-port type isolator) in accordance with a preferred embodiment of the present invention.

A basic structure of a 2-port type isolator as one example of a nonreciprocal circuit device according to a preferred embodiment of the present invention will now be described. As shown in FIG. 1, the 2-port type isolator 1 is preferably a lumped constant type isolator, which preferably includes a circuit board 20, a ferrite-magnet assembly 30 which includes a ferrite 32 and a pair of permanent magnets 41 and a chip type resistor R, which is an element of a matching circuit.

Figure 2:
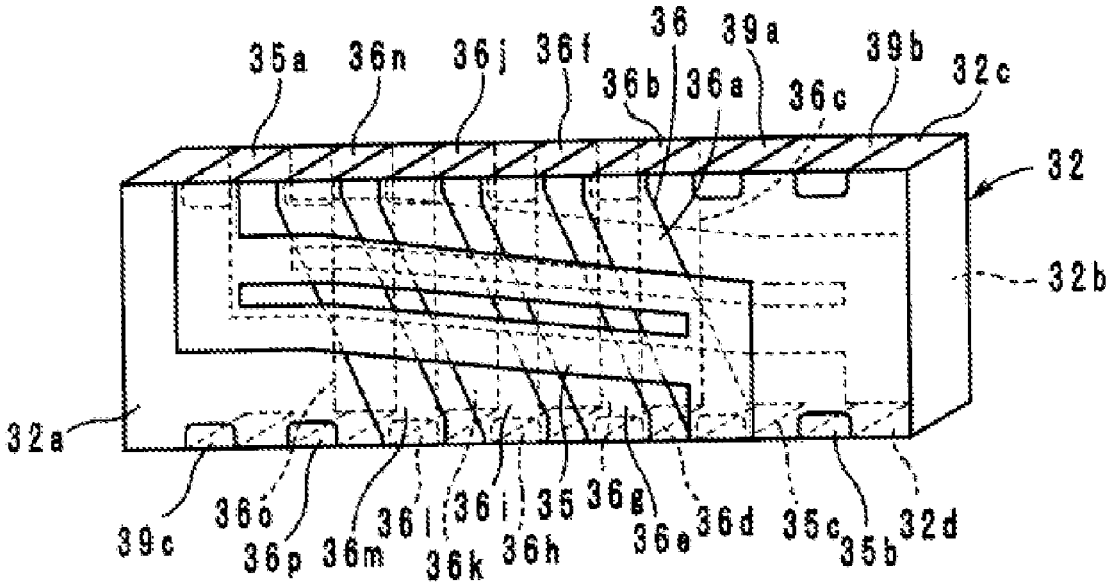
FIG. 2 is a perspective view illustrating a ferrite with a central electrode.

As shown in FIG. 2, a first central electrode 35 and a second central electrode 36, which are electrically insulated from each other, are located on front and back main surfaces 32*a* and 32*b* of the ferrite 32. The ferrite 32 preferably has a rectangular parallelepiped shape having the first main surface 32*a* and the second main surface 32*b* mutually parallel to each other, for example.

Figure 4:
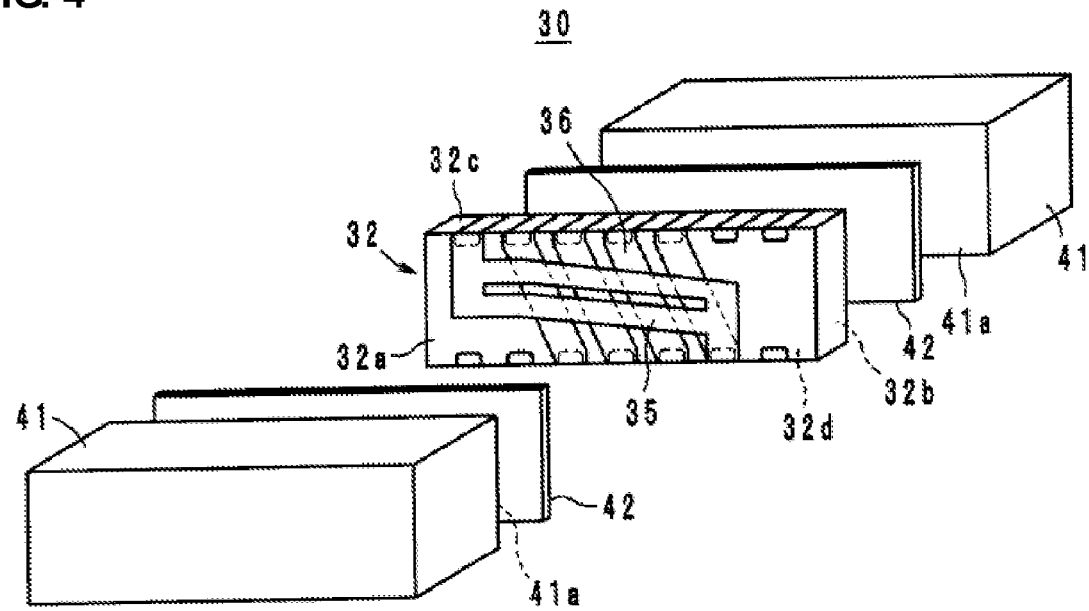
FIG. 4 is an exploded perspective view illustrating the ferrite-magnet assembly.

The permanent magnets 41 are bonded onto the main surfaces 32*a* and 32*b*, for example, using an epoxy based adhesive agent 42 (see FIG. 4) so that a magnetic field is applied substantially perpendicular to the main surfaces 32*a* and 32*b*. The permanent magnets 41 thus define the ferrite-magnet assembly 30. The main surfaces of the permanent magnets 41 preferably have the same or substantially the same dimensions as the main surfaces 32*a* and 32*b*, and are mounted with the main surfaces 32*a* and 41*a*, and the main surfaces 32*b* and 41*a*, mutually facing each other so that the outlines of the main surfaces are aligned.

The first central electrode 35 preferably includes a conductive film. That is, as shown in FIG. 2, the first central electrode 35 extends on the first main surface 32*a* of the ferrite 32, rising from the lower right portion of the first main surface 32*a*, and being bifurcated into two lines in the middle thereof. The first central electrode 35 is thus inclined at a relatively small angle with respect to the long side of the first main surface 32*a* to the upper left portion of the ferrite 32. The first central electrode 35 rises to the upper left portion of the first main surface 32*a*, and is then routed to the second main surface 32*b* via a relay electrode 35*a* on the top surface 32*c*. The first central electrode 35 then extends on the second main surface 32*b*, and is bifurcated into two lines in the middle thereof such that the extended portion of the first central electrode 35 on the first main surface 32*a* and the extended portion thereof on the second main surface 32*b* oppose each other with the ferrite 32 disposed therebetween. One end of the first central electrode 35 is connected to a connection electrode 35*b* located on the bottom surface 32*d*. The other end of the first central electrode 35 is connected to a connection electrode 35*c* located on the bottom surface 32*d*. In this way, the first central electrode 35 is wound around the ferrite 32 by one turn. The first central electrode 35 crosses the second central electrode 36 (described in more detail later) with an insulator layer (not shown) interposed therebetween in an electrically insulated manner. A crossing angle between the central electrodes 35 and 36 is set as necessary in order to adjust input impedance and insertion loss.

The second central electrode 36 preferably includes a conductive film. As the second central electrode 36, first, a 0.5-turn second central electrode 36*a* is provided, extending from the lower side to the upper side of the first main surface 32*a* at a relatively large angle with respect to the long side of the first main surface 32*a* such that the second central electrode 36*a* crosses the first central electrode 35. The second central electrode 36*a* is routed via a relay electrode 36*b* on the top surface 32*c* to the second main surface 32*b*, and then a 1-turn second central electrode 36*c* extends substantially vertically, crossing the first central electrode 35. The lower portion of the 1-turn second central electrode 36*c* is routed to the first main surface 32*a* via a relay electrode 36*d* on the bottom surface 32*d*. A 1.5-turn second central electrode 36*e* extends in parallel or substantially in parallel with the 0.5-turn second central electrode 36*a* on the first main surface 32*a* such that the 1.5-turn second central electrode 36*e* crosses the first central electrode 35. The 1.5-turn second central electrode 36*e* is then routed to the second main surface 32*b* via a relay electrode 36*f* on the top surface 32*c*. Similarly, a 2-turn second central electrode 36*g*, a relay electrode 36*h*, a 2.5-turn second central electrode 36*i*, a relay electrode 36*j*, a 3-turn second central electrode 36*k*, a relay electrode 36*l*, a 3.5-turn second central electrode 36*m*, a relay electrode 36*n*, and a 4-turn second central electrode 36*o* are successively provided on the surfaces of the ferrite 32. Both ends of the second central electrode 36 are respectively connected to the connection electrode 35*c* and 36*p* located on the bottom surface 32*d* of the ferrite 32. It is noted that the first central electrode 35 and the second central electrode 36 respectively share the connection electrode 35*c* as the terminal connection electrodes thereof.

Figure 3:
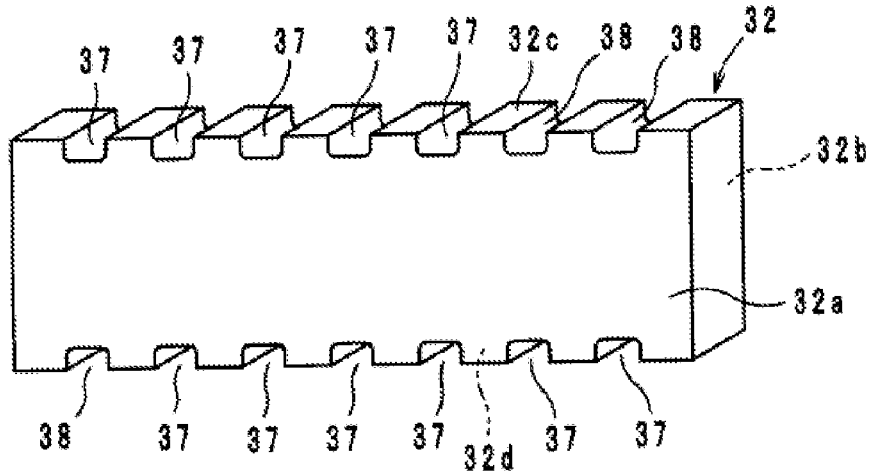
FIG. 3 is a perspective view illustrating the ferrite element.

The connection electrodes 35*b*, 35*c*, and 36*p* and the relay electrodes 35*a*, 36*b*, 36*d*, 36*f*, 36*h*, 36*j*, 36*l*, and 36*n* are formed preferably by applying or filling cutout portions 37 (see FIG. 3) formed on the top and bottom surfaces 32*c* and 32*d* of the ferrite 32 with electrode conductor, such as silver, silver-based alloy, copper or copper-based alloy, for example. Dummy cutout portions 38 are formed on the top surface 32*c* and 32*d* in parallel or substantially in parallel with electrodes and then dummy electrodes 39*a*, 39*b* and 39*c* are produced. These types of electrodes are preferably formed as described below. Through-holes are opened beforehand in a mother ferrite board, and then filled with electrode conductor. The mother ferrite board is then cut along a line that splits the through-holes. The electrodes may also be defined by a conductor layer deposited on the cutout portions 37 and 38.

YIG ferrite is preferably used for the ferrite 32, for example. The first and second central electrodes 35 and 36 and the electrodes are preferably produced as a thick film or a thin film of silver or a silver-based alloy using printing, transfer printing, or photolithographic printing technique, for example. The insulator layer for the central electrodes 35 and 36 may preferably be a dielectric thick film made of glass or alumina, or a resin film made of polyimide, for example. The insulator layer may also be produced using printing, transfer printing, or photolithographic printing technique, for example.

The ferrite 32 composed of magnetic material can be produced by co-firing with the insulator layer and various electrodes. In such a case, electrode material, such as Cu, Ag, Pd, or Ag/Pd, which can withstand a high firing temperature is preferably used, for example.

The permanent magnet 41 is preferably a strontium-based ferrite magnet, a lanthanum-cobalt based ferrite magnet, or a barium-based ferrite magnet, for example. As an adhesive agent 42 for bonding the permanent magnet 41 and the ferrite 32, thermo-setting one-component epoxy resin is preferred.

Figure 5:
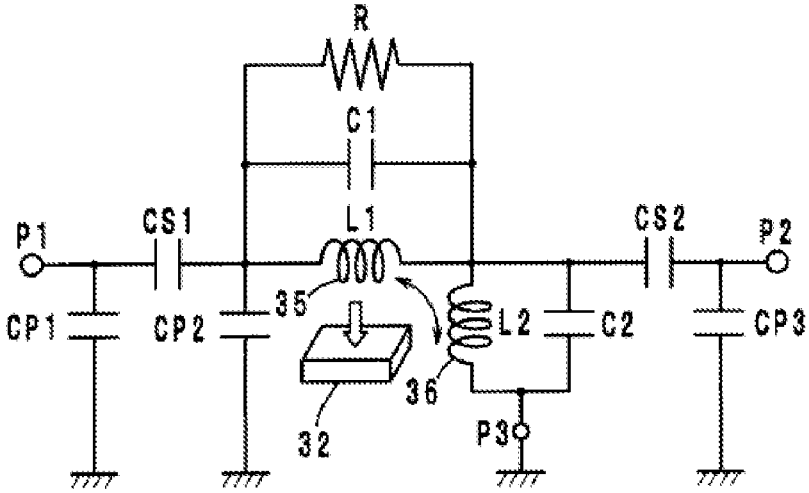
FIG. 5 is an equivalent circuit diagram illustrating a basic circuit of the 2-port type isolator.

The circuit board 20 preferably includes a ceramic multilayered substrate. The terminal electrodes 25*a*, 25*b*, 25*c*, 25*d*, 25*e* for mounting the ferrite-magnet assembly 30 and chip type resistor R, the input-output terminal electrodes 26 and 27, and the ground electrode 28 are provided on main surfaces of the circuit board 20. Referring to FIG. 5, the circuit board 20 includes internal electrodes to define components of the matching circuit (Capacitor C1, C2, CS1, CS2, CP1, CP2, and CP3), and a designated circuit is formed through via-hole conductors and other elements, as described in more detail below.

The ferrite-magnet assembly 30 is mounted on the circuit board 20. The electrodes 35*b*, 35*c* and 36*p* on the bottom surface 32*d* of the ferrite 32 are preferably soldered to and form unitary bodies with the terminal electrodes 25*a*, 25*b*, and 25*c* on the circuit board 20, respectively, through a reflow soldering operation, for example. The underside of the permanent magnets 41 are bonded onto the circuit board 20 into a unitary body using an adhesive agent, for example. The chip resistor R is connected to the terminal electrodes 25*d* and 25*e* through the reflow soldering operation, for example.

An equivalent circuit of an example of the isolator 1 is shown in FIG. 5. An input port P1 is connected to a matching capacitor C1 and a terminal resistor R via a matching capacitor CS1, and the matching capacitor CS1 is connected to one end of a first central electrode 35. The other end of the first central electrode 35 and one end of second central electrode 36 are connected to the terminal resistor R, the capacitor C1 and a capacitor C2, and connected to output port P2 via a capacitor CS2 as well. The other end of the second central electrode 36 and the capacitor C2 are connected to ground port P3.

A grounded capacitor CP1 is connected between the input port P1 and the capacitor CS1. A grounded capacitor CP2 is connected between the capacitor CS1 and one end of the first central electrode 35. A grounded capacitor CP3 is connected between the output port P2 and capacitor CS2.

Since one end of the first central electrode 35 is connected to the input port P1 and the other end is connected to the output port P2, and one end of the second central electrode is connected to the output port P2 and the other end is connected to the ground port P3, a 2-port type lumped constant isolator with low insertion loss can be obtained by the 2-port type isolator 1 including the above described equivalent circuit. Furthermore, in the operation mode, a large high frequency current flows through the second central electrode 36, while almost no high-frequency current flows through the first central electrode 35.

In addition, the ferrite-magnet assembly 30 is mechanically reliable because the ferrite 32 and a pair of permanent magnets 41 are bonded together into a unitary body by an adhesive agent 42. Thus, the ferrite-magnet assembly 30 provides a robust isolator that is free from deformation and damage caused by vibrations and shocks.

Functions of each component for the matching circuit will now be described. Capacitor C1 determines the isolation frequency. A capacitance value that maximizes isolation in the operating frequency band is preferred for Capacitor C1. Capacitor C2 determines the transmission frequency. A capacitance value that minimizes insertion loss in the operating frequency band is preferred for Capacitor C2. Capacitors CS1 and CS2 define the characteristic impedance of the isolator 1 to be about 50Ω, for example. Capacitance values that minimize insertion loss in the operating frequency band are preferred for Capacitors CS1 and CS2. Resistor R absorbs reverse direction power as a terminal resistor of the isolator 1. A resistance value that maximizes isolation in the operating frequency band is preferred for Resistor R.

Capacitors CP1, CP2 and CP3 define the characteristic impedance of the isolator 1 so as to equal approximately 50Ω, for example. Capacitance values of CP1 and CP2 that maximize input-return loss and minimizing insertion loss in the operating frequency band are preferred. Capacitance values of CP3 that maximize output-return loss and minimize insertion loss in the operating frequency band are preferred.

Figure 6:
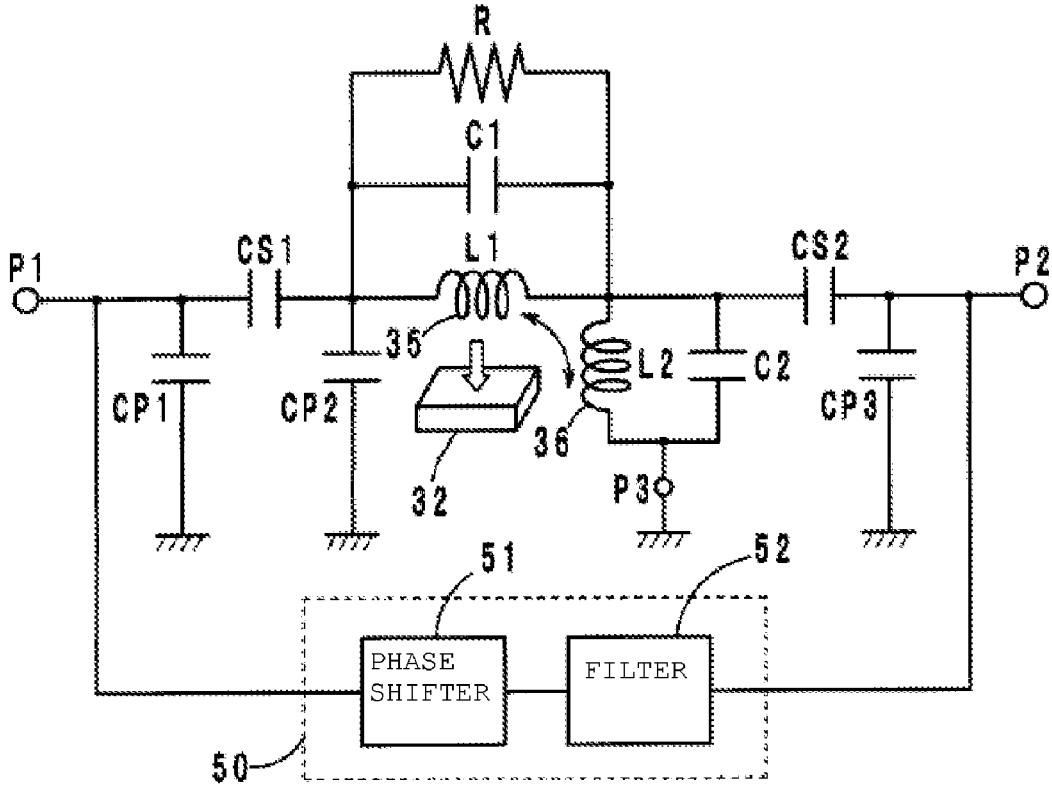
FIG. 6 is an equivalent circuit diagram illustrating a first circuit example when a bypass circuit is provided.

As shown in FIG. 6 as a first circuit example, the nonreciprocal circuit device in accordance with a preferred embodiment of the present invention includes a bypass circuit 50. The bypass circuit 50 preferably includes a phase shifter 51 and a filter 52, and does not allow operating wave signals to pass therethrough. The bypass circuit 50 is connected between the input port P1 and the output port P2.

The phase shifter 51 may preferably include a capacitor or variable-length coaxial tube, for example. Unnecessary waves passing through the phase shifter are converted to have a phase that is opposite to that of unnecessary waves passing through the isolator 1 at output port P2. The unnecessary waves passing through the bypass circuit 50 meet the unnecessary waves passing through the isolator 1 at output port P2. If these two unnecessary waves have opposite phases compared to each other, unnecessary waves are attenuated by canceling each other out.

The filter 52 selectively allows unnecessary waves to be attenuated to pass through the filter 52. For example, waves having harmonics of 2 times, 3 times, 4 times, 5 times, may be allowed to pass through the filter 52. It is preferable that the amplitude of the unnecessary waves at the outlet of the bypass circuit 50 is substantially the same as the amplitude of unnecessary waves passing through the isolator 1. The filter 52 may be defined by a high-pass filter, a band-pass filter, a low-pass filter, and a band elimination filter, for example.

If the filter 52 is a high-pass filter, it is preferable to set a cutoff frequency to be equal to or greater than about 1.5 times the fundamental frequency but less than or equal to about 3.5 times the fundamental frequency, for example. If the filter 52 is a band-pass filter, it is preferable to set a center frequency of the band to be equal to or greater than about 1.5 times the fundamental frequency but less than or equal to about 3.5 times the fundamental frequency, for example. If the filter 52 is a band elimination filter, it is preferable to set the elimination band to be inclusive of or close to the fundamental frequency, for example.

Figure 7:
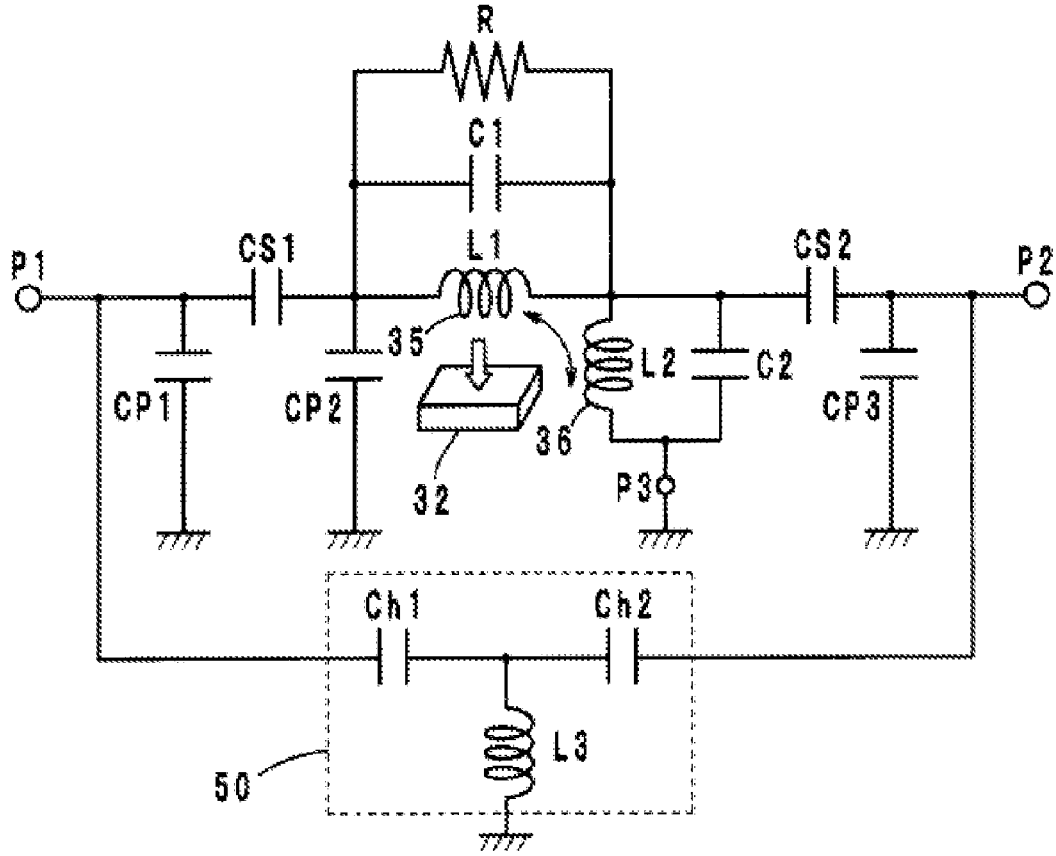
FIG. 7 is an equivalent circuit diagram illustrating a specific first circuit example.

FIG. 7 shows a specific example of forming a bypass circuit 50 with a high-pass filter. The high-pass filter preferably includes two capacitors Ch1, Ch2 and an inductor L3 which is connected between capacitors Ch1 and Ch2, and defines a T-type circuit arranged to attenuate 3 times harmonics.

Figure 8:
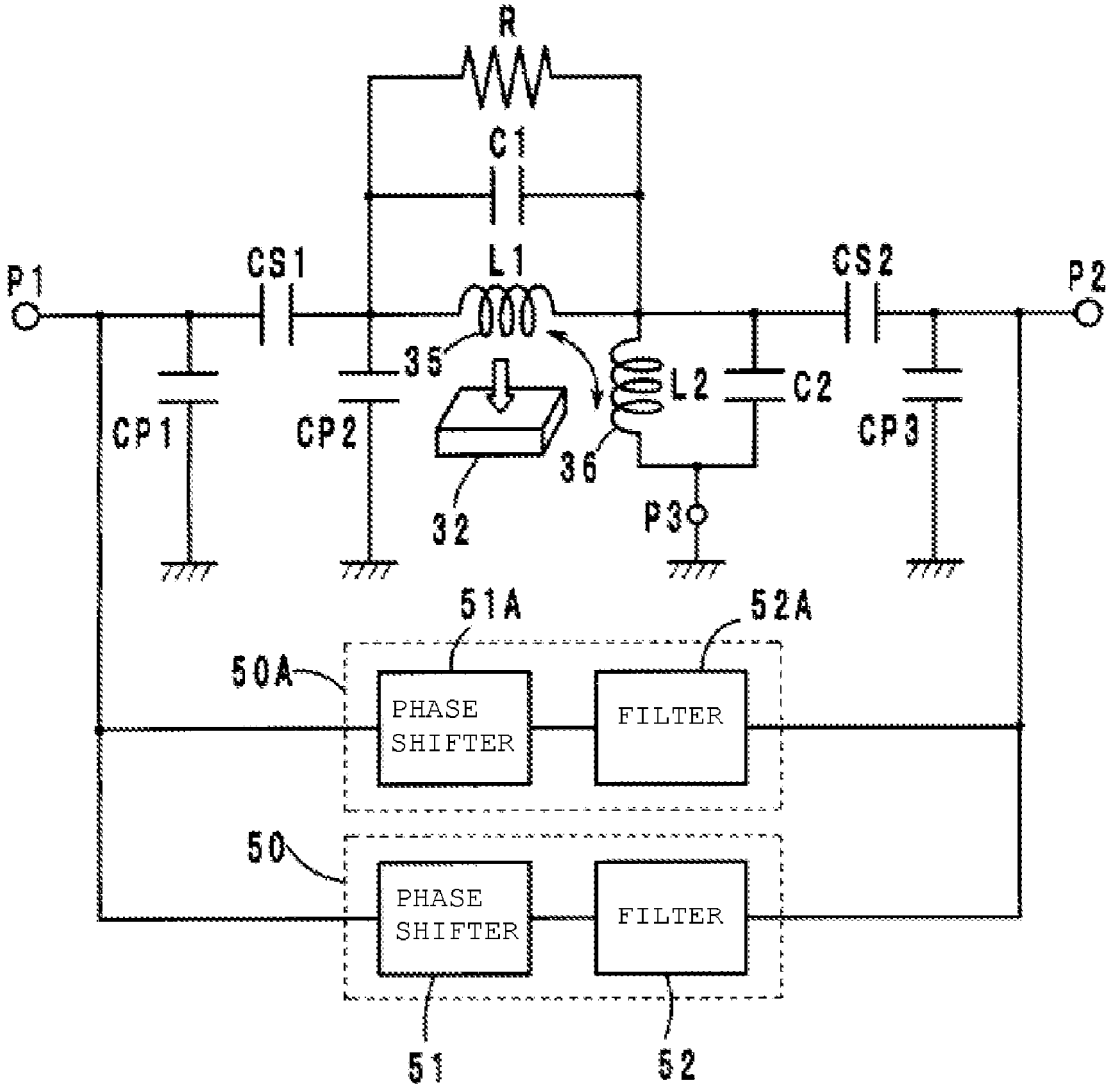
FIG. 8 is an equivalent circuit diagram illustrating a second circuit example when a bypass circuit is provided.
Figure 9:
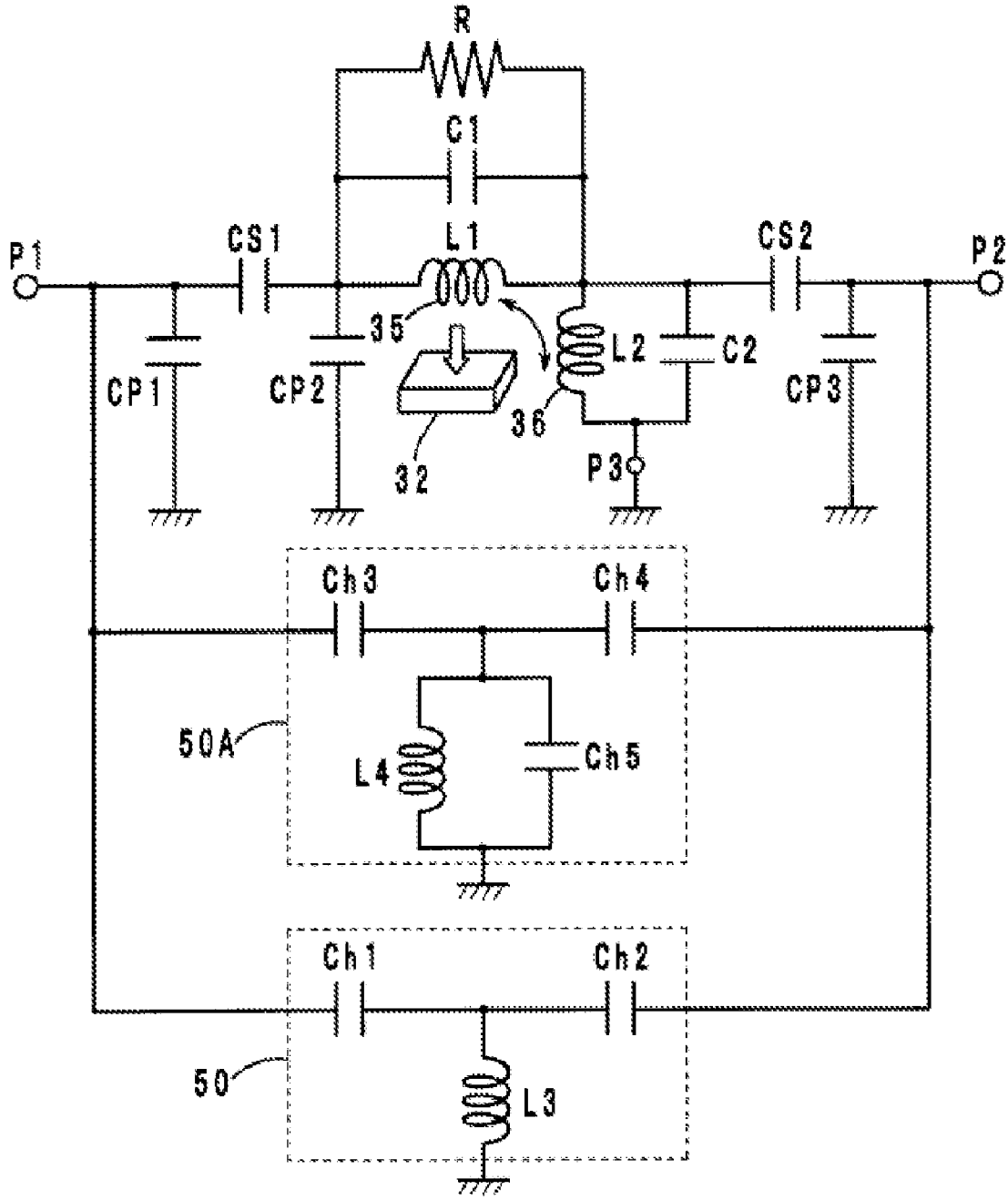
FIG. 9 is an equivalent circuit diagram illustrating a specific second circuit example.

FIG. 8 shows a second example of connecting two bypass circuits 50 and 50A in parallel between an input port P1 and an output port P2. Specifically, a bypass circuit 50 defines the T-type high-pass filter shown in FIG. 7 to attenuate 3 times harmonics. Another bypass circuit 50A is a single stage band-pass filter including capacitors Ch3 and Ch4 and a parallel resonance circuit including a capacitor Ch5 and an inductor L4, wherein the resonance circuit is connected between Ch3 and Ch4. The bypass circuit 50A is configured to attenuate a 2 times harmonics.

Bypass circuits 50 and 50A described above can be formed by embedding each component into the circuit board 10, for example. The bypass circuits 50 and 50A may also be formed by mounting the components on the circuit board 20, for example.

Next, characteristics of the isolator including the basic circuit example shown in FIG. 5 and the first circuit example (bypass circuit 50) shown in FIG. 7 are described. Circuit parameters for the measurement are as follows.

Figure 10:
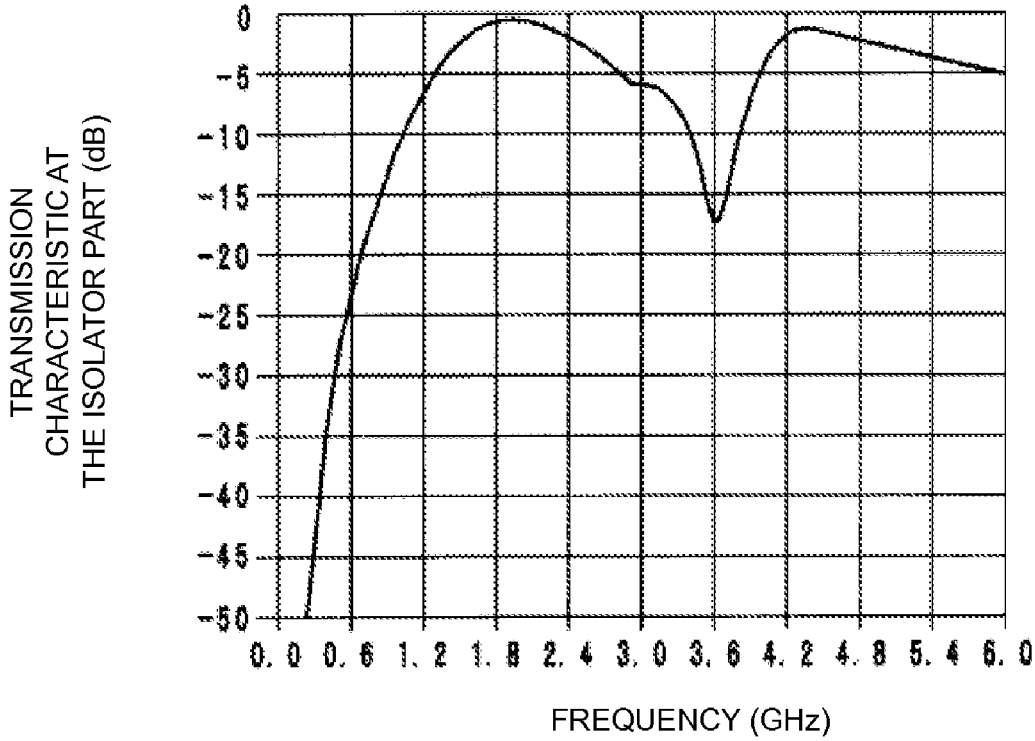
FIG. 10 is a graph that shows a transmission characteristic of the circuit shown in FIG. 5.
Figure 11:
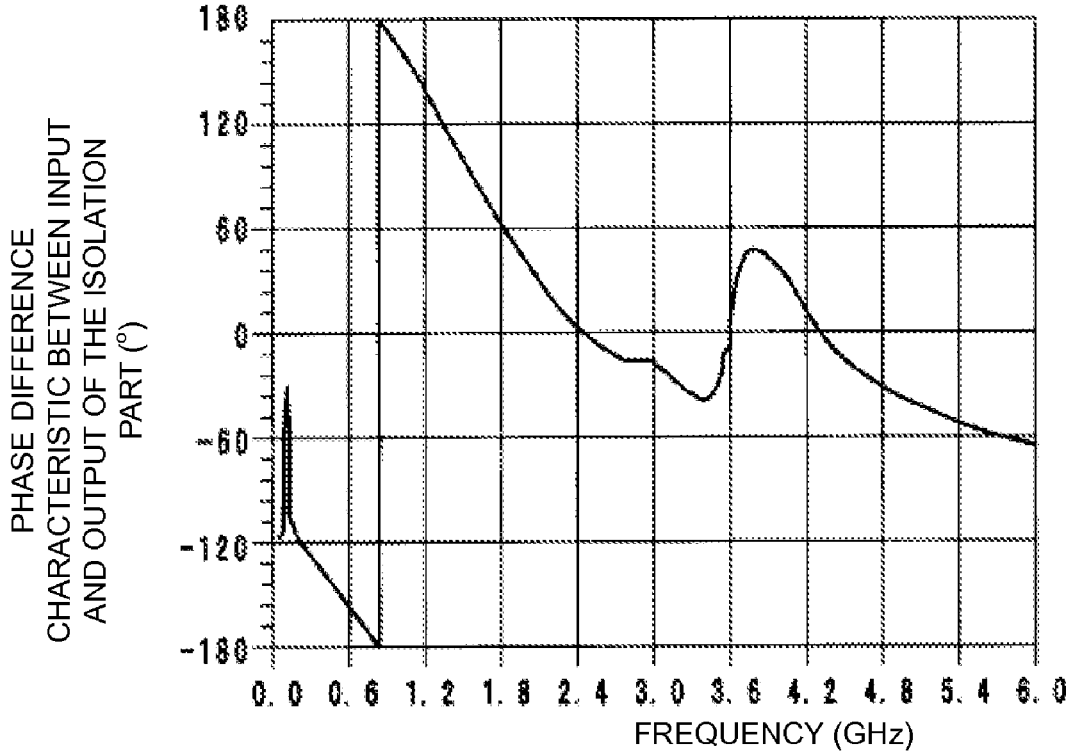
FIG. 11 is a graph that shows a phase difference between input and output signals of the circuit shown in FIG. 5.
Figure 12:
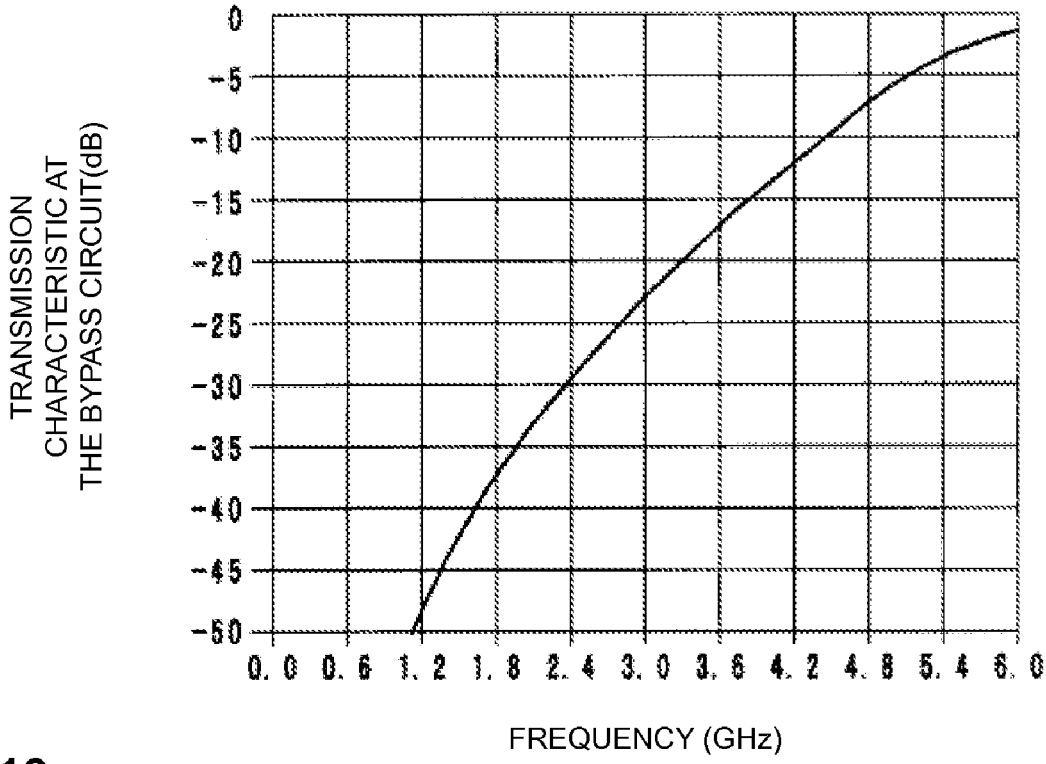
FIG. 12 is a graph that shows a transmission characteristic of the bypass circuit shown in FIG. 7.
Figure 13:
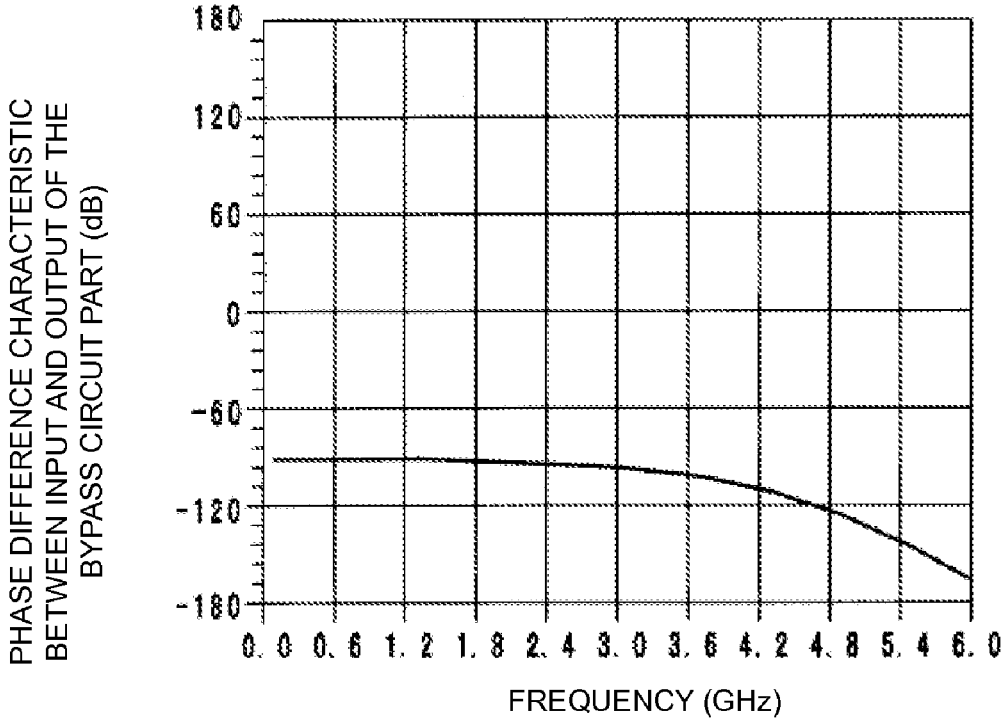
FIG. 13 is a graph that shows a phase difference between input and output signals of bypass circuit shown in FIG. 7.
Figure 14:
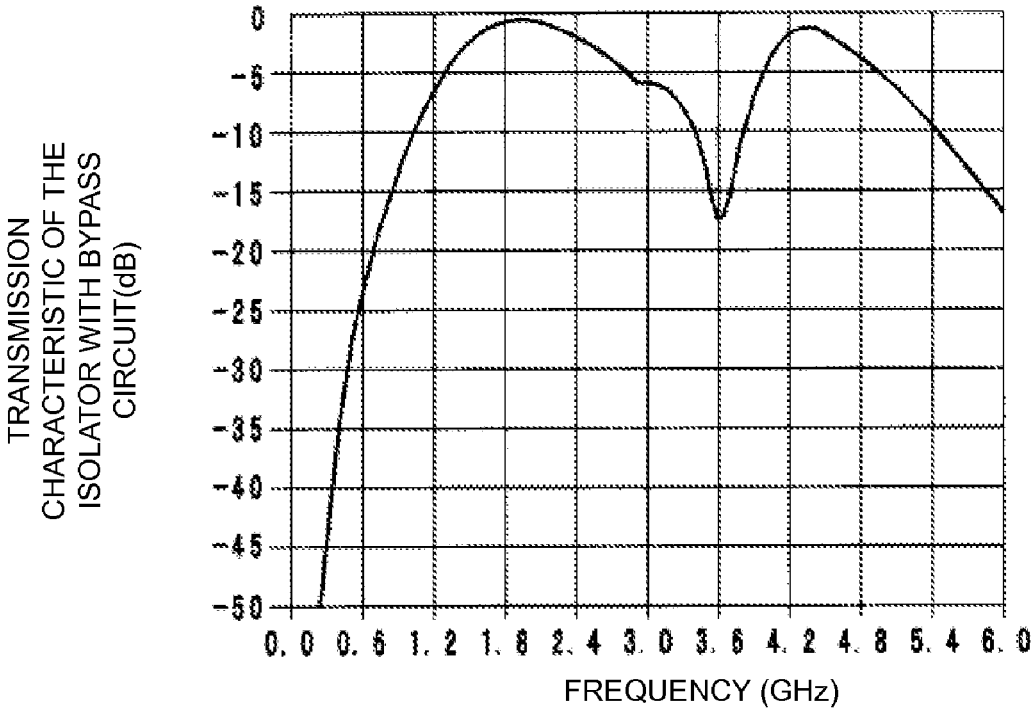
FIG. 14 is a graph that shows a transmission characteristic of the isolator according to a preferred embodiment of the present invention.

First central electrode (Inductor L1): 1.7 nH
Second central electrode (Inductor L2): 22 nH
Capacitor C1: 4 pF
Capacitor C2: 0.3 pF
Capacitor CS1: 2.5 pF
Capacitor CS2: 3.5 pF
Resistor: 390Ω
Capacitor CP1: 0.05 pF
Capacitor CP2: 0.05 pF
Capacitor CP3: 0.05 pF
Capacitor Ch1: 0.3 pF
Capacitor Ch2: 0.3 pF
Inductor L3: 1.0 nH FIG. 10 illustrates the transmission (amplitude) characteristic at the isolator shown in FIG. 5. FIG. 11 illustrates the phase difference characteristic between input and output of the isolator. FIG. 12 illustrates the transmission (amplitude) characteristic at the bypass circuit 50 shown in FIG. 7. FIG. 13 illustrates the phase difference characteristic between input and output of the bypass circuit 50. FIG. 14 illustrates the transmission (amplitude) characteristic of the isolator equipped bypass circuit 50.

The fundamental frequency is preferably about 1.9 GHz, for example. Comparing FIG. 10 and FIG. 14, it is apparent transmission characteristic at frequency above about 4.2 GHz is attenuated. The attenuation values range from several dB to 10 dB in this example. By comparing FIG. 10 and FIG. 12, and by comparing FIG. 11 and FIG. 13, the comparison analysis leads to a conclusion that the frequency in which the amplitude values are exactly equal and the phase difference is exactly 180° (reverse phase) does not exist. However, the simple bypass circuit provides advantageous effects.

Higher efficiency (lower insertion loss, higher isolation) can be obtained by adding the bypass circuit. That is, since the input-output impedance of the filter is extremely high at the fundamental frequency of the isolator, the bypass circuit does not influence the operation at the fundamental frequency band.

The bypass circuit contributes to providing a more compact and thinner isolator. That is, a circuit for attenuating unnecessary waves can be provided without utilizing a high Q value inductor which is large in size, for example.

In addition, wide band attenuation and multiple band attenuation can be provided by designing a bypass circuit for a specific purpose. By providing a trap circuit which utilizes resonance, the isolator can attenuate a signal in a predetermined frequency band only. Meanwhile, by utilizing a bypass circuit, the isolator can attenuate unnecessary waves in a wide frequency band or in multiple bands.

The bypass circuit is not influenced by the operating impedance of the internal circuit of the isolator. That is, the bypass circuit can be designed and can function independently from the operation of the internal circuit of the isolator. Even if the isolator operates with a relatively high impedance of about 70Ω to about 200Ω, instead of about 50Ω, and impedance conversion is performed by an input-output impedance matching circuit to about 50Ω, the influence on the operation and design is not significant.

Figure 15:
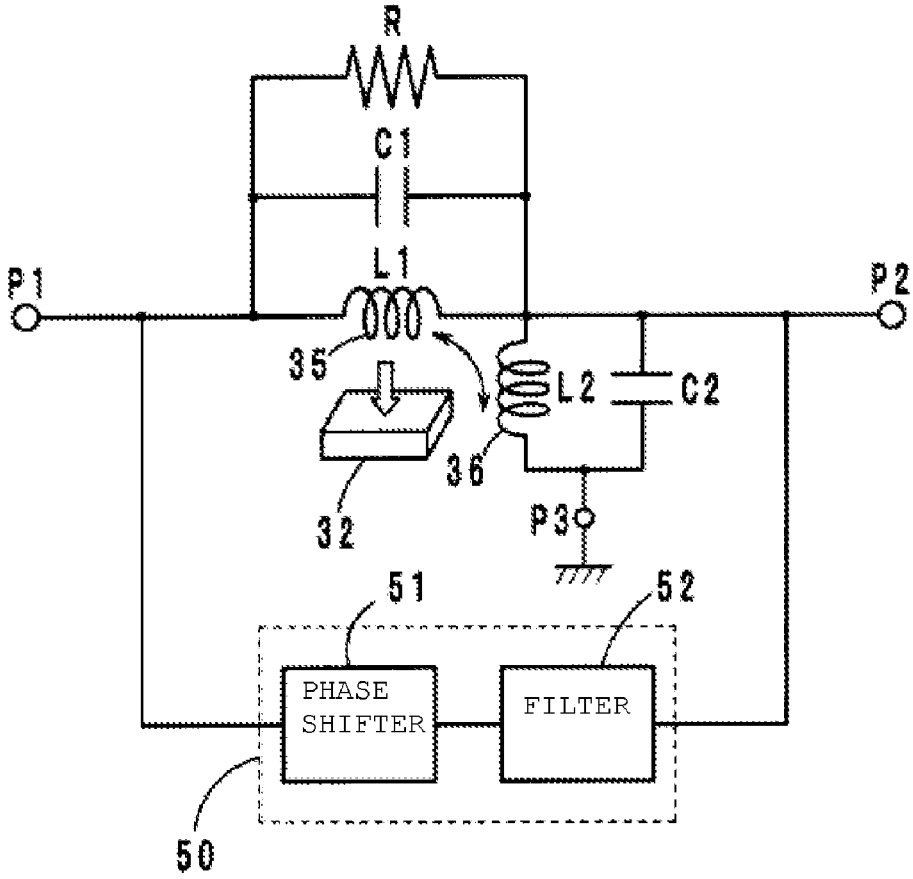
FIG. 15 is an equivalent circuit diagram illustrating another circuit example of the isolator according to a preferred embodiment of the present invention.

The bypass circuit has been described as preferably being applied to the isolator in which the central electrodes 35 and 36 are wound around two major surfaces 32*a* and 32*b* of the ferrite 32. Even if the central electrodes adjacent to each other on one of the major surfaces of the ferrite, or one of the major surfaces and one of the side surfaces of the ferrite, desired effects and advantages obtained by providing the bypass circuit are achieved. In such a case, the ferrite is preferably arranged on the circuit board such that a first main surface of the ferrite is parallel or substantially parallel to a surface of the circuit board. Connecting electrodes which connect the central electrode to the matching circuit and input-output terminals are provided on the second main surface of the ferrite. FIG. 15 shows an equivalent circuit of this type of isolator which is connected with the bypass circuit 50 including the shifter 51 and the filter 52.

The present invention is not limited to the above described preferred embodiments, and the nonreciprocal circuit devices of the present invention can be modified in various ways within the scope of the present invention.

In particular, the structure and arrangement of the matching circuit are unconstrained. A conductive adhesive, ultrasonic bonding, or a bridge bond, for example, may be utilized for bonding the ferrite-magnet assembly and the matching circuit to the circuit board instead of bonding with solder as described above with respect to a preferred embodiment of the present invention.

As described above, preferred embodiments of the present invention are useful for a nonreciprocal circuit device, and are particularly superior in attenuating an unnecessary wave having a frequency that is higher than a fundamental wave, without increasing insertion loss.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

a permanent magnet;

a ferrite arranged to receive a direct-current magnetic field from the permanent magnet;

a first central electrode and a second central electrode arranged on the ferrite so as to cross each other and so as to be electrically insulated from each other, a first end of the first central electrode is electrically connected to an input port and a second end of the first central electrode is electrically connected to an output port, a first end of the second central electrode is electrically connected to the output port and a second end of the second central electrode is electrically connected to a ground port;

a first matching capacitor electrically connected between the input port and the output port;

a second matching capacitor electrically connected between the output port and the ground port;

a resistor electrically connected between the input port and the output port; and a bypass circuit electrically connected between the input port and the output port and including a phase shift portion and a filter portion arranged to prevent signals in a fundamental wave band from passing through the bypass circuit; wherein the bypass circuit is arranged such that, while performing phase shifting, the bypass circuit generates unnecessary waves having an opposite phase to that of unnecessary waves at the output port, and the bypass circuit selectively passes the generated unnecessary waves having the opposite phase to cancel out the unnecessary waves at the output port.

2. The nonreciprocal circuit device according to claim 1, further comprising a plurality of the bypass circuits electrically connected in parallel between the input port and the output port.

3. The nonreciprocal circuit device according to claim 1, wherein the filter is a filter selected from the group consisting of a hi-pass filter, a band-pass filter, a low-pass filter, and a band elimination filter.

4. The nonreciprocal circuit device according to claim 1, wherein the first central electrode and the second central electrode are arranged on each main surface of the ferrite and are parallel or substantially parallel to each other.

5. The nonreciprocal circuit device according to claim 4, further comprising a conductive film arranged to fix the first central electrode and the second central electrode on each main surface of the ferrite.

6. The nonreciprocal circuit device according to claim 4, wherein the second central electrode is wound around the ferrite at least one turn.

* * * * *